United States Patent [19]

Cho

[11] Patent Number: 4,881,638

[45] Date of Patent: Nov. 21, 1989

[54] GOLF BAG WITH DIVIDER AND PUTTER HOUSING

[75] Inventor: Sung C. Cho, Seoul, Rep. of Korea

[73] Assignee: Haidon Industrial Co., Ltd., Seoul, Rep. of Korea

[21] Appl. No.: 199,378

[22] Filed: May 27, 1988

[30] Foreign Application Priority Data

Mar. 9, 1988 [KR] Rep. of Korea ..... 3122[U]

[51] Int. Cl.[4] ..... A63B 55/00

[52] U.S. Cl. ..... 206/315.3; 206/315.5; 206/315.6

[58] Field of Search ..... 206/315.2, 315.3, 315.4, 206/315.5, 315.7, 315.6, 315.8; 190/110

[56] References Cited

U.S. PATENT DOCUMENTS

| | | | |
|---|---|---|---|
| 1,597,870 | 8/1926 | Reach | 206/315.6 |
| 2,325,474 | 7/1943 | Cart | 206/315.7 |
| 2,595,987 | 5/1952 | Shears | 206/315.6 |
| 4,172,484 | 10/1979 | Henning | 206/315.6 |
| 4,174,747 | 11/1979 | Boles | 206/315.6 |
| 4,194,547 | 3/1980 | Sidor et al. | 206/315.6 |
| 4,241,774 | 12/1980 | Pell | 206/315.6 |
| 4,263,950 | 4/1981 | Brown | 206/315.6 |
| 4,282,912 | 8/1981 | Brown | 206/315.6 X |
| 4,311,178 | 1/1982 | Kennedy | 206/315.6 |
| 4,383,563 | 5/1983 | Kirchhoff, Jr. | 206/315.3 X |
| 4,420,024 | 12/1983 | Clayton | 206/315.6 X |
| 4,509,643 | 4/1985 | Rhee | 206/315.6 X |
| 4,512,465 | 4/1985 | Jobe | 206/315.4 |
| 4,691,823 | 9/1987 | Pape | 206/315.6 |
| 4,709,814 | 12/1987 | Antonious | 206/315.6 X |
| 4,768,650 | 9/1988 | Chancellor, Jr. | 206/315.6 X |

*Primary Examiner*—Sue A. Weaver

*Attorney, Agent, or Firm*—Paul L. Sjoquist

[57] ABSTRACT

A golf bag having a divider assembly in a suspended U-shape which may be easily disassembled and assembled, and an exterior putter housing extending longitudinally on the side.

3 Claims, 6 Drawing Sheets

GOLF BAG WITH DIVIDER AND PUTTER HOUSING

BACKGROUND OF THE INVENTION

1. Field of the Invention

The present invention relates to a golf bag with a divider assembly and a putter housing and, more particularly, this invention relates to a golf bag which is provided with a divider assembly to be easily disassembled and assembled in order to prevent mutual entanglement of a grip portion of a golf club when the golf clubs are inserted into and removed from the golf bag, which is provided with putter housing on the exterior of the golf bag in order to carry the putter separately.

2. Description of the prior art

In a conventional golf bag, when golf clubs are inserted into and removed from the golf bag the golf clubs are easily entangled. In order to overcome drawbacks for such entanglement of the golf clubs within the golf bag, the conventional golf bag is provided with dividers of plastics or cloth, to be integratedly sewed to the inner surface of the bag.

Accordingly, such a conventional bag with dividers is inconvenient to clean the interior of the golf bag, and breakage of the divider or the bag may be produced when the golf clubs are inserted into and removed from the golf bag in using the bag for a long time.

In breaking the divider in the conventional golf bag, the golf bag with the broken divider must be replaced with a new golf bag with a new divider, for the broken golf bag is not effective. Further, the divider of the conventional golf bag is long formed from an upper end to a lower end of an insert tube to be integrally connected with the bag as a united body.

Such a conventional divider has much consumption of raw material and is complex for the working process, and has possibility for increasing the production cost.

Additionally, a light weight golf bag may not be possible because the golf bag with the conventional divider is weighty.

In a conventional golf bag, when putters which are shorter than other golf clubs are inserted together with another golf clubs within the golf bag, the head portions of the putter is inserted within the golf bag and other golf clubs may be entangled with the head portion of the putter. When the golf clubs are removed from the golf bag, the grip portions of the golf clubs may be caught in the head portion of the putter.

Such inserting and removing of the golf clubs in the golf bag is very inconvenient.

U.S. Pat. No. 4,311,178 to Kennedy ("Interior Spaced Divider for Golf Bag) discloses longitudinal divider panels which are inserted into a cylinder defined by an outer sheath.

U.S. Pat. No. 4,194,547 to Sider et al. ("Golf Club Holder") discloses golf club bags and golf club bag inserts for facilitating the orderly arrangement of golf clubs. A golf club holder has an elongate tube of a resilient material, first and second ends, and dividers.

U.S. Pat. No. 4,282,912 to Brown ("Universal Golf Bag") discloses a golf bag which can be altered in configuration to be used in a variety of situations. The top insert has bar-separators.

U.S. Pat. No. 4,172,284 to Henning ("Golf Bag") discloses a plurality of comparments provided by a honey comb-shaped frame work of a cloth-like material. The bag has a spike insertable into the ground to hold the bag in an upright position. The bag is constructed to hold a full set of fourteen clubs.

U.S. Pat. No. 4,448,305 to Sup ("Golf Bag Including Stiffening Structures") discloses a longitudinally elongated golf bag having an open upper end, a closed lower end, and a flexible wall extending between said ends and about a hollow interior adapted to receive golf club shafts.

U.S. Pat. No. 4,383,563 to Kirchhoff, Jr. ("Golf Bag) discloses a rigid body with a separate tube for the shaft of each club and a deck with cradles shaped to fit the respective club heads. The tubes are shaped to frictionally retain the clubs by their handgrips.

U.S. Pat. No. 4,263,950 to Brown ("Golf Bag Top Insert") is disclosed for insertion into the top of a golf bag, comprising a longitudinally-tapered body with an insert in the shape of the perimeter of the top of the bag, with a stop rigidly secured to the insert and a gripping device operative to aid movement.

The top insert has bar-separators.

The bar-separators may be utilized to separate golf equipment which are placed into the bag.

The bag has a series of male snaps, such as a top male snap.

U.S. Pat. Nos. 4,304,278; 4,334,564; 4,512,465 and 4,241,774 are of prior art devices which have been previously designed.

As described in the above listed patent references, a number of different devices and systems have been devised to properly separate clubs, but there are no golf bags with a divider assembly and a putter housing as described herein.

SUMMARY OF THE INVENTION

The prior art problems are overcome with the golf bag according to the present invention. The golf bag of the present invention is cable of disassembling and assembling a divider with a belt or strap, and is provided with a putter housing on the outside of the golf bag.

It is an object of this invention to provide a novel golf bag with a divider assembly and a putter housing which will be cheaper than conventional golf bags, and to comprise in combination a divider assembly with a divider wall of cloth forming a spacedly divided interior space of the golf bag and being fixedly positioned only at the upper ends of the divider wall, with a U-shaped divider wall long extending down into the bag without any fixation; and a putter housing which can be inserted to carry a shorter putter and which is provided with a cylindrical tube shape separately on the exterior of the golf bag.

It is another object of this invention to provide a novel golf bag in order to prevent mutual entanglement of a grip portion of a golf club when the golf club is inserted into and removed from the golf bag.

These and other objects and advantages of the invention will become apparent from the following description made with reference to the preferred embodiment of the invention in the accompanying drawings and from the claims.

DESCRIPTION OF THE PREFERRED EMBODIMENTS

Figure 1:
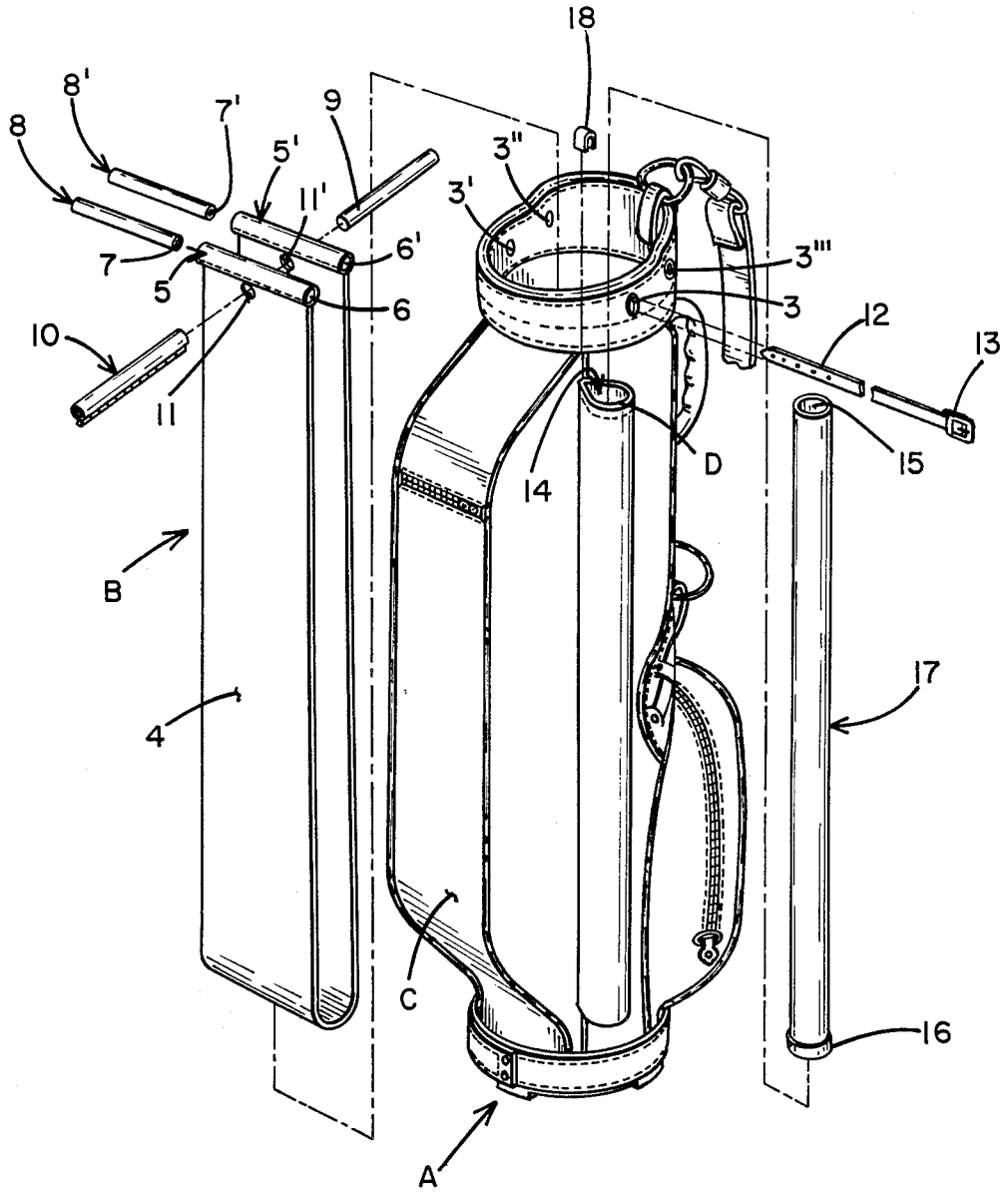
FIG. 1 is an exploded perspective view of a golf bag with a divider assembly and a putter housing according to the present invention.
Figure 2:
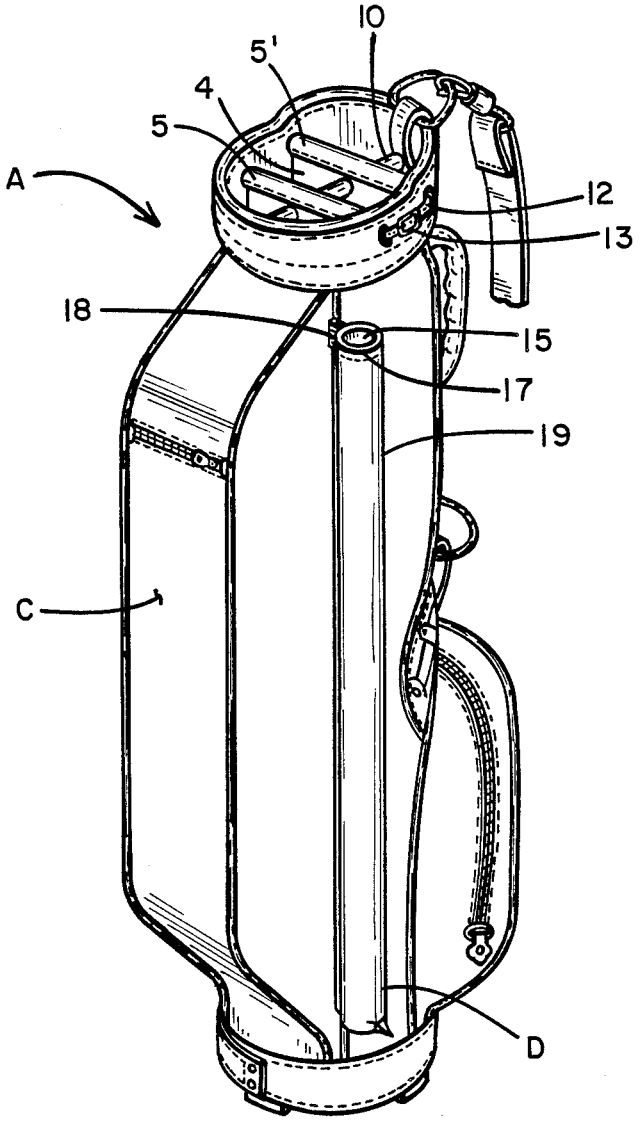
FIG. 2 is an entire perspective view of a fabricated golf bag with a divider assembly and a putter housing according to the present invention.

One embodiment of the present invention will hereunder be described by referring to the drawings. As shown in FIGS. 1 and 2, insertion holes 3,3',3'' and 3''' are oppositely and spacedly bored on the upper annular portion of the golf bag A.

A divider B, which is finally positioned in the interior of the golf bag A, has a cloth divider wall 4 to be suspended down with a U-Shape from the upper portion to the lower portion in the interior of the golf bag A.

Both ends of the cloth divider wall 4 of the divider B are formed into loops 6 and 6' to be sewed up with a leather cover to form looped ends 5 and 5'.

Two plastic pipes 8 and 8' are formed having insertion holes 7 and 7', and plastic pipes 8 and 8' are inserted through looped ends 5 and 5'.

A simple divider tube 10, into which is inserted a plastic rod 9 and sewed up with a leather cover, is inserted through holes 11 and 11' underneath the middle part of the looped ends 5 and 5' on the cloth divider wall 4.

The divider B, as shown in FIG. 2, is positioned on the upper annular portion of the golf bag A.

The looped ends 5 and 5', respectively are aligned with insertion holes 3, 3', 3'', and 3''' on the upper annular portion of the golf bag A, and a strap or belt 12 is firstly inserted through the hole 3, and then through the hole 3' and 3'', finally to the hole 3'''.

After insertion of the strap or belt 12 through the holes 3, 3', 3'' and 3''' the end portion of the strap or belt 12 is tightly locked with a buckle 13 with the strap or belt 12.

Figure 3:
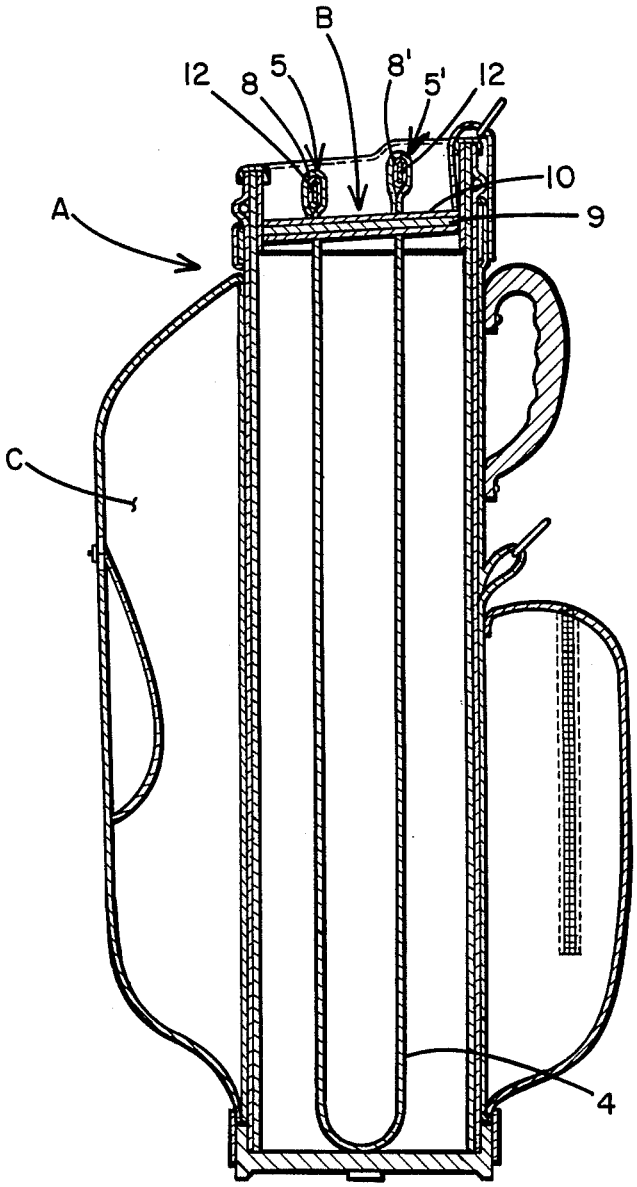
FIG. 3 is an entire sectional view of the present invention.

By tightly locking with the buckle 13, the divider B itself is positioned in the golf bag A, as shown in FIG. 3.

The cloth divider wall 4 has an U-shaped configuration, and the U-shaped divider wall 4 is suspended down within the golf bag A and divides the interior of the golf bag A.

Further, on one side of a rear pocket C on the exterior of the golf bag A, a housing D is sewed, and an opening 14 is formed. A putter pipe 17 which is formed with a cylindrical stopper 16, is inserted in the opening 14.

The upper portion of the opening 14 is clamped with a metal clip 18 to form a putter housing 19.

Figure 4:
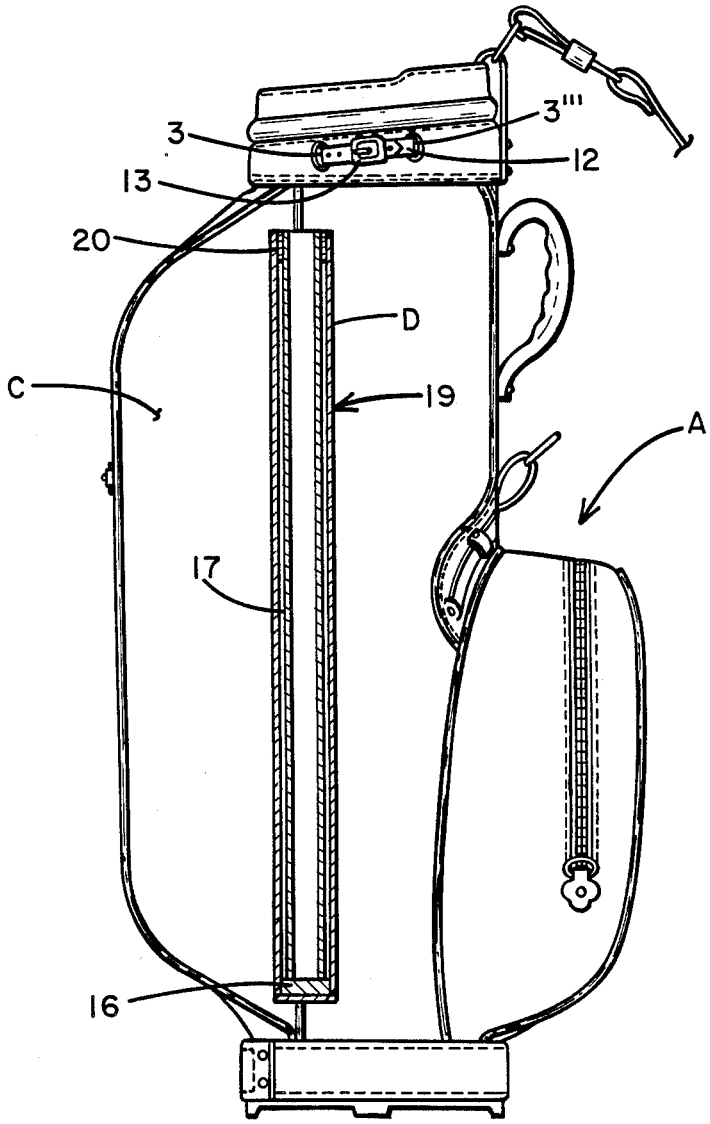
FIG. 4 is a partially cut away side elevational view according to the present invention.
Figure 5:
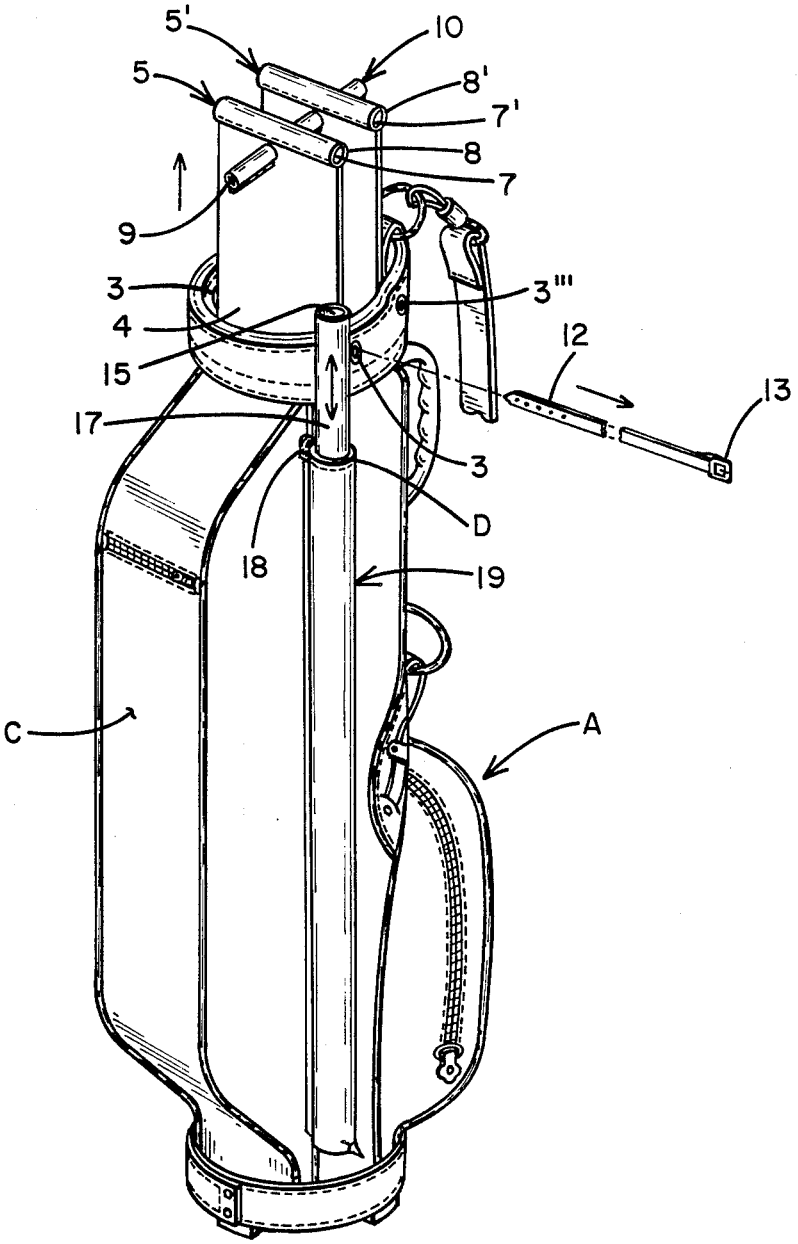
FIG. 5 is a detail view showing an operational state according to the present invention.

As shown in FIG. 4, a closed end portion 20 has a sewed up portion of the outer sheath D on the upper end portion of the putter housing 19.

When a putter E is inserted and removed in the putter pipe 17 the putter is not fully inserted, and is caught by the closed end portion 20 on the upper end portion of the outer housing 14.

In case of cleaning up the interior of the golf bag A, or in case of replacing the divider B itself, the strap or belt 12 is firstly disengaged from the buckle 13 and the belt is removed from the holes by pulling.

The divider B may then be lifted up and disassembled easily, and the interior of the golf bag can then be cleaned.

Further, a broken divider B may be replaced with a new divider B and the new divider B is inserted in the interior of the golf bag A, in the same manner as described above, and the upper portion of the new divider B can be tightly assembled.

In addition, interior of the golf bag A can be conveniently cleaned up because the divider B is not formed as a compartment unit as with a conventional fixed divider.

Further consumption of raw materials of the divider B is not much and the working process is convenient. Cost of manufacture and weight of the divider B can be reduced because the divider B itself is not integratedly formed with plastic or cloth from the upper portion of the interior of the golf bag A to the bottom thereof.

Figure 6:
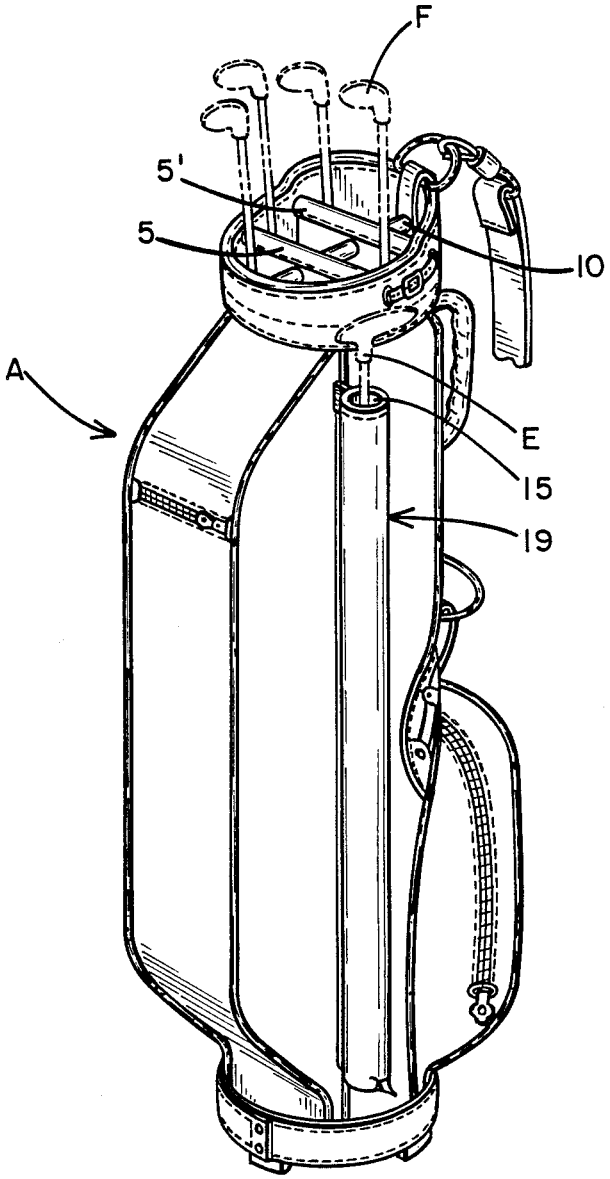
FIG. 6 is a view of the invention with golf clubs.

As shown in FIG. 6, short putter E is separated from golf clubs F and inserted into a putter housing 19 longitudinally formed on the exterior of the golf bag A to be carried conveniently.

Conventional drawbacks in case of inserting and removing other golf clubs and a shorter putter E are overcome and the golf bag is very convenient.

What is claimed is:

1. A golf bag and insert, comprising in combination:

(a) a golf bag having a body portion defining an elongated interior recess and an upper annular edging about an upper periphery of the body portion, and a first pair of transversely opposed aligned openings through said edging, and a second pair of transversely opposed aligned openings through said edging spaced apart from said first pair;

(b) a flexible insert comprising an elongated strip of material having a width approximately equal to the distance between said aligned openings, said strip having respective ends formed into loops and having a center section suspended into the interior recess of said golf bag defining a U-shaped divider;

(c) a first tube passing through one of said loops and arranged between said first pair of aligned openings, and a second tube passing through the other of said loops and arranged between said second pair of aligned openings; and (d) a belt passing serially through said aligned openings, said first tube and said second tube, and having fastening means for interlocking said belt in attaching said tubes and said golf bag together, thereby containing said flexible insert in suspension in said interior recess.

2. The apparatus of claim 1, further comprising a third tube orthogonally positioned relative to said first and second tubes, and passing beneath said first and second tubes and through openings below said two loops of said flexible insert.

3. The apparatus of claim 2, further comprising a putter housing attached to the outside of said golf bag body portion, said putter housing comprising an elongated loop and a tube removably inserted into said loop.

* * * * *